US011204154B2

(12) United States Patent
Lax et al.

(10) Patent No.: US 11,204,154 B2
(45) Date of Patent: Dec. 21, 2021

(54) LIGHTING ASSEMBLY

(71) Applicant: Autronic Plastics, Inc., Central Islip, NY (US)

(72) Inventors: Daniel A. Lax, Roslyn, NY (US); Agjah I. Libohova, East Setauket, NY (US); Timothy J. Keuning, Northport, NY (US)

(73) Assignee: Autronic Plastics, Inc., Central Islip, NY (US)

( * ) Notice: Subject to any disclaimer, the term of this patent is extended or adjusted under 35 U.S.C. 154(b) by 0 days.

(21) Appl. No.: 16/742,838

(22) Filed: Jan. 14, 2020

(65) Prior Publication Data

US 2020/0149711 A1 May 14, 2020

Related U.S. Application Data

(63) Continuation of application No. 15/455,872, filed on Mar. 10, 2017, which is a continuation of application (Continued)

(51) Int. Cl.
*F21V 17/00* (2006.01)
*F21S 8/00* (2006.01)

(Continued)

(52) U.S. Cl.
CPC ..... *F21V 17/002* (2013.01); *F21S 2/005* (2013.01); *F21S 8/033* (2013.01); *F21S 8/04* (2013.01);

(Continued)

(58) Field of Classification Search
CPC ..... F21S 4/28; F21V 23/009; F21V 23/026; F21V 31/005

(Continued)

(56) References Cited

U.S. PATENT DOCUMENTS 2,463,046 A 9/1945 Naysmith
2,527,216 A 4/1947 Harris (Continued)

FOREIGN PATENT DOCUMENTS

KR 1487340 B1 2/2015
WO 2007030542 A2 3/2007
WO 2014134608 A2 9/2014

OTHER PUBLICATIONS

Philips Lumileds Press Information, Jan. 23, 2007.

(Continued)

*Primary Examiner* — William J Carter
(74) *Attorney, Agent, or Firm* — Zollinger & Burleson Ltd.

(57) ABSTRACT

A modular lighting assembly uses LED banks as the light sources. The assembly allows the power supply and LED banks to be independently replaced. The assembly uses a power supply that is separated from the LED banks and electrically connected to the LED banks with a plug connector that may be unplugged and plugged back in to allow the power supply or LED bank to be independently and readily replaced. The assembly provides for easy replacement of the different components of the assembly. One feature that makes the components easier to replace is that the light modules and/or the power supply may be carried by the housing that is removable from the base mount that is secured to a mounting structure such as a wall or ceiling.

13 Claims, 4 Drawing Sheets

Related U.S. Application Data

No. 13/271,115, filed on Oct. 11, 2011, now Pat. No. 9,625,139.

(60) Provisional application No. 61/391,608, filed on Oct. 9, 2010.

(51) Int. Cl.

| | |
|---|---|
| ***F21V 23/02*** | (2006.01) |
| ***F21S 2/00*** | (2016.01) |
| ***F21V 29/76*** | (2015.01) |
| ***F21S 8/04*** | (2006.01) |
| ***F21V 21/02*** | (2006.01) |
| ***F21V 17/16*** | (2006.01) |
| ***F21V 19/04*** | (2006.01) |
| ***F21V 21/08*** | (2006.01) |
| ***F21V 21/30*** | (2006.01) |
| ***F21V 23/06*** | (2006.01) |
| *F21K 9/20* | (2016.01) |
| *F21Y 105/10* | (2016.01) |
| *F21Y 115/10* | (2016.01) |
| *F21V 17/10* | (2006.01) |
| *F21V 19/00* | (2006.01) |
| *F21W 131/101* | (2006.01) |
| *F21W 131/40* | (2006.01) |
| *F21Y 113/00* | (2016.01) |

(52) U.S. Cl.

CPC ..... *F21S 8/043* (2013.01); *F21V 17/164* (2013.01); *F21V 19/04* (2013.01); *F21V 21/02* (2013.01); *F21V 21/08* (2013.01); *F21V 21/30* (2013.01); *F21V 23/02* (2013.01); *F21V 23/023* (2013.01); *F21V 23/026* (2013.01); *F21V 23/06* (2013.01); *F21V 29/76* (2015.01); *F21K 9/20* (2016.08); *F21V 17/104* (2013.01); *F21V 19/001* (2013.01); *F21W 2131/101* (2013.01); *F21W 2131/40* (2013.01); *F21Y 2105/10* (2016.08); *F21Y 2113/00* (2013.01); *F21Y 2115/10* (2016.08)

(58) Field of Classification Search

USPC ..... 362/227, 249.01, 249.02, 362, 368, 374, 362/375, 800

See application file for complete search history.

(56) References Cited

U.S. PATENT DOCUMENTS

| | | | | |
|---|---|---|---|---|
| 2,673,286 | A | 3/1954 | Moore | |
| 3,504,172 | A | 3/1970 | Liberman | |
| 3,746,921 | A | 7/1973 | Marshall et al. | |
| 4,369,487 | A | 1/1983 | Carlow | |
| 4,627,679 | A | 12/1986 | Billette de Villemeur et al. | |
| 4,907,767 | A | 3/1990 | Corsi et al. | |
| 5,024,614 | A | 6/1991 | Dola et al. | |
| 5,062,246 | A | 11/1991 | Sykes | |
| 5,342,221 | A | 8/1994 | Peterson | |
| 5,568,129 | A | 10/1996 | Sisselman et al. | |
| 5,608,375 | A | 3/1997 | Kosich | |
| 5,792,992 | A | 8/1998 | Handler | |
| 6,072,708 | A | 6/2000 | Fischer | |
| 6,283,621 | B1 | 9/2001 | Macri | |
| 6,323,421 | B1 | 11/2001 | Pawson et al. | |
| 6,513,289 | B1 | 2/2003 | Decore et al. | |
| 6,538,568 | B2 | 3/2003 | Conley, III | |
| 6,739,734 | B1 | 5/2004 | Hulgan | |
| 6,979,907 | B2 | 12/2005 | Li et al. | |
| 7,086,747 | B2 | 8/2006 | Nielson et al. | |
| 7,140,742 | B2 | 11/2006 | Pohlert et al. | |
| 7,178,941 | B2 | 2/2007 | Roberge et al. | |
| 7,227,278 | B2 | 6/2007 | Realmuto et al. | |
| 7,229,185 | B1 | 6/2007 | Galvez et al. | |
| 7,360,929 | B2 | 4/2008 | Pfund et al. | |
| 7,387,407 | B2 | 6/2008 | Tseng | |
| 7,470,036 | B2 | 12/2008 | Deighton et al. | |
| 7,663,898 | B2 | 2/2010 | Lindemann et al. | |
| 7,766,536 | B2 | 8/2010 | Peifer et al. | |
| 7,828,456 | B2 | 11/2010 | Boyer et al. | |
| 7,922,354 | B2 * | 4/2011 | Everhart | F21V 23/009 362/235 |
| 7,926,982 | B2 | 4/2011 | Liu | |
| 7,972,035 | B2 | 7/2011 | Boyer | |
| 8,018,161 | B2 | 9/2011 | Smith, III et al. | |
| 8,113,687 | B2 | 2/2012 | Villard et al. | |
| 8,136,958 | B2 | 3/2012 | Verfuerth et al. | |
| 8,138,690 | B2 | 3/2012 | Chemel et al. | |
| 8,294,379 | B2 | 10/2012 | Liu et al. | |
| 8,299,712 | B2 | 10/2012 | Smith, III et al. | |
| 8,313,211 | B2 | 11/2012 | Libohova et al. | |
| 8,339,069 | B2 | 12/2012 | Chemel et al. | |
| 8,376,583 | B2 | 2/2013 | Wang et al. | |
| 8,398,276 | B2 | 3/2013 | Pearson et al. | |
| 8,531,134 | B2 | 9/2013 | Chemel et al. | |
| 8,814,376 | B2 | 8/2014 | Nicolai et al. | |
| 9,316,370 | B2 | 4/2016 | Lax et al. | |
| 9,425,649 | B2 | 8/2016 | Singer et al. | |
| 9,625,139 | B2 | 4/2017 | Lax et al. | |
| 9,672,700 | B2 | 6/2017 | Lax | |
| 9,897,305 | B2 | 2/2018 | Ryder et al. | |
| 9,909,748 | B2 | 3/2018 | Lax et al. | |
| 9,995,444 | B2 | 6/2018 | Leichner | |
| 10,386,027 | B1 | 8/2019 | Lax et al. | |
| 10,443,827 | B2 | 10/2019 | Lax et al. | |
| 2002/0193955 | A1 | 12/2002 | Bertness et al. | |
| 2003/0072145 | A1 | 4/2003 | Nolan et al. | |
| 2004/0160199 | A1 | 8/2004 | Morgan et al. | |
| 2004/0257789 | A1 | 12/2004 | Nielson et al. | |
| 2005/0018435 | A1 | 1/2005 | Selkee et al. | |
| 2005/0174755 | A1 | 8/2005 | Becker | |
| 2005/0190078 | A1 | 9/2005 | Salter | |
| 2005/0221659 | A1 | 10/2005 | Mrakovich et al. | |
| 2005/0254237 | A1 | 11/2005 | Nath et al. | |
| 2006/0215422 | A1 | 9/2006 | Laizure, Jr. et al. | |
| 2007/0064450 | A1 | 3/2007 | Chiba et al. | |
| 2007/0070622 | A1 | 3/2007 | Allen | |
| 2007/0189001 | A1 | 8/2007 | Nielson et al. | |
| 2007/0195527 | A1 | 8/2007 | Russell | |
| 2007/0222399 | A1 | 9/2007 | Bondy et al. | |
| 2007/0247842 | A1 | 10/2007 | Zampini et al. | |
| 2007/0274084 | A1 * | 11/2007 | Kan | F21V 5/002 362/373 |
| 2008/0080162 | A1 | 4/2008 | Wilcox et al. | |
| 2008/0155915 | A1 | 7/2008 | Howe et al. | |
| 2008/0212319 | A1 | 9/2008 | Klipstein | |
| 2008/0265799 | A1 | 10/2008 | Sibert | |
| 2008/0297701 | A1 | 12/2008 | Lee et al. | |
| 2009/0034261 | A1 | 2/2009 | Grove | |
| 2010/0019690 | A1 | 1/2010 | Libohova et al. | |
| 2010/0148697 | A1 | 6/2010 | Bayat et al. | |
| 2010/0244721 | A1 | 9/2010 | Shloush et al. | |
| 2010/0296285 | A1 | 11/2010 | Chemel et al. | |
| 2010/0296536 | A1 | 11/2010 | Tao | |
| 2011/0058358 | A1 | 3/2011 | Soo et al. | |
| 2011/0292658 | A1 | 12/2011 | Ho | |
| 2012/0007516 | A1 | 1/2012 | Lax et al. | |
| 2012/0080944 | A1 | 4/2012 | Recker et al. | |
| 2012/0127702 | A1 | 5/2012 | Lax et al. | |
| 2012/0168576 | A1 | 7/2012 | Intravatola | |
| 2013/0201658 | A1 | 8/2013 | Bogart et al. | |
| 2013/0342234 | A1 | 12/2013 | Sabre et al. | |
| 2014/0226072 | A1 | 8/2014 | Ikuta | |
| 2014/0240966 | A1 | 8/2014 | Garcia et al. | |
| 2014/0254132 | A1 | 9/2014 | Nicolai et al. | |
| 2014/0320011 | A1 | 10/2014 | Hegarty | |
| 2015/0009666 | A1 | 1/2015 | Keng et al. | |
| 2015/0330587 | A1 | 11/2015 | Lax et al. | |
| 2015/0338084 | A1 | 11/2015 | Ryder et al. | |
| 2016/0035192 | A1 | 2/2016 | Lax | |
| 2016/0102825 | A1 | 4/2016 | Scribante et al. | |

(56) References Cited

U.S. PATENT DOCUMENTS

| | | | |
|---|---|---|---|
| 2016/0323981 | A1 | 11/2016 | Clark et al. |
| 2017/0138758 | A1 | 5/2017 | Ricci |
| 2017/0254517 | A1 | 9/2017 | Nijkamp et al. |

OTHER PUBLICATIONS

ProTran 1, 120 VAC LED Safety Light, Sep. 12, 2008.
ProTran 1, 1000VDC LED Safety Light, Sep. 12, 2008.
ProTran 1, 1000VDC White LED Portable Lamp Bank for MOW, Dec. 20, 2008.
Lumascape, LED Product Catalogue 2008, Mar. 2008.
Copyright 2014, Apogee Translite, Inc., series 98J LED, Spec Sheet.
Apogee Translite, Series 70 LED Tunnel Light webpage, copyright 2015, accessed Sep. 2015 from www.apogeetranslite.com.
Clear-vu lighting METROGUIDE Pathlight, publication date unknown, document includes date of Sep. 25, 2013.
Apogee Translite, Series 70 LED Tunnel Light, Specification Sheet, copyright 2015.
Jul. 27, 2016 MTA NYCT Enhanced Station Initiative Program Design Criteria Manual; Contract A-36622A.
Jul. 26, 2016 Platform Component Details NCCT Contract A-36622A.
Copyright 2014, Apogee Translite, Inc., series 99 EM LED, Spec Sheet.
Petition for Inter Partes Review of U.S. Pat. No. 9,909,748, IPR2020-01023, filed Jun. 3, 2020.
Petition for Inter Partes Review of U.S. Pat. No. 9,909,748, IPR2020-01023, filed Jun. 3, 2020, Exhibit 1003, Declaration of Eric Bretschneider.
Petition for Inter Partes Review of U.S. Pat. No. 10,190,760, IPR2020-01024, filed Jun. 3, 2020.
Petition for Inter Partes Review of U.S. Pat. No. 10,190,760, IPR2020-01024, filed Jun. 3, 2020, Exhibit 1003, Declaration of Eric Bretschneider.
United States District Court for the Eastern District of New York Central Islip Division, Case 2:19-cv-06268-MKB-ST, Document 1, filed Nov. 6, 2019, Complaint (114 pages).
United States District Court for the Eastern District of New York Central Islip Division, Case 2:19-cv-06268-MKB-ST, Document 14, filed Dec. 3, 2019, Answer, and Verified Counterclaims for Tortious Interference with Contractual Relations, Tortious Interference with Prospective Business Advantage, and for Declaratory Judgment of Noninfringement and Invalidity (58 pages).
United States District Court for the Eastern District of New York Central Islip Division, Case 2:19-cv-06268-MKB-ST, Document 16, filed Dec. 3, 2019, Order to Show Cause for Preliminary Injunction with temporary Restraining Order (3 pages).
United States District Court for the Eastern District of New York Central Islip Division, Case 2:19-cv-06268-MKB-ST, Document 17, filed Dec. 3, 2019, Memorandum of Law in Support of Defendants-Counterclaim Plainliff's Motion for a Temporary Restraining Order and Preliminary Injunction (15 pages).
United States District Court for the Eastern District of New York Central Islip Division, Case 2:19-cv-06268-MKB-ST, Document 18, filed Dec. 3, 2019, Declaration as to Compliance with Local Civil Rule 6.1(d) and Fed. R. Civ. P. 65(b) (3 pages).
United States District Court for the Eastern District of New York Central Islip Division, Case 2:19-cv-06268-MKB-ST, Document 19, filed Dec. 3, 2019, Letter to Honorable Roslynn R. Mauskopf, U.S.D.J. (2 pages).
United States District Court for the Eastern District of New York Central Islip Division, Case 2:19-cv-06268-MKB-ST, Document 21, filed Dec. 5, 2019, Plaintiff Clear-vu's Opposition to Defendant Apogee's Motion for a Temporary Restraining Order and preliminary Injunction (19 pages).
United States District Court for the Eastern District of New York Central Islip Division, Case 2:19-cv-06268-MKB-ST, Document 23, filed Dec. 13, 2019, Letter to Honorable Roslynn R. Mauskopf, U.S.D.J. (1 page).
United States District Court for the Eastern District of New York Central Islip Division, Case 2:19-cv-06268-MKB-ST, Document 24, filed Dec. 16, 2019, Apogee's Reply and Notice of Withdrawal of Request for a preliminary Injunction (4 pages).
United States District Court for the Eastern District of New York Central Islip Division, Case 2:19-cv-06268-MKB-ST, Document 30, Letter to Douglas C. Palmer, Clerk of Courts, reporting related case (2 pages).
United States District Court for the Eastern District of New York, Case 1:20-cv-00470-MKB, Document 1, Complaint (138 pages).
United States District Court for the Eastern District of New York Central Islip Division, Case 2:19-cv-06268-MKB-ST, Document 33, First Amended Answer and Counterclaims (37 pages).
United States District Court for the Eastern District of New York Central Islip Division, Case 2:19-cv-06268-MKB-ST, Document 34, Letter to The Honorable Steven L. Tiscione, reporting Discovery Plan Worksheet (6 pages).
United States District Court for the Eastern District of New York Central Islip Division, Case 2:19-cv-06268-MKB-ST, Document 36, Letter to The Honorable Margo K. Brodie, Pre-motion Conference Letter (3 pages).
United States District Court for the Eastern District of New York Central Islip Division, Case 2:19-cv-06268-MKB-ST, Document 38, Civil Minute Entry (1 page).
United States District Court for the Eastern District of New York Central Islip Division, Case 2:19-cv-06268-MKB-ST, Document 40, Answer of Defendant Smalls Electrical Construction, Inc. (9 pages).
United States District Court for the Eastern District of New York Central Islip Division, Case 2:19-cv-06268-MKB-ST, Document 42, Notice of Plaintiff's Motion to Dismiss Defendant's Counterclaim for Tortious Interference with Prospective Business Advantage (69 pages).
United States District Court for the Eastern District of New York Central Islip Division, Case 2:19-cv-06268-MKB-ST, Document 43, Reply Brief in Support of Plaintiff's Motion to Dismiss Defendant's Counterclaim for Tortious Interference with Prospective Business Advantage (14 pages).
United States District Court for the Eastern District of New York Central Islip Division, Case 2:19-cv-06268-MKB-ST, Document 44, Apogee's Brief in Opposition to Plaintiff's Motion to Dismiss Defendant's Counterclaim for Tortious Interference with Prospective Business Advantage (26 pages).
United States District Court for the Eastern District of New York Central Islip Division, Case 2:19-cv-06268-MKB-ST, Document 46, [Proposed] Protective Order Regarding the Disclosure and Use of Discovery Materials (20 pages).
Petition for Inter Partes Review of U.S. Pat. No. 9,909,748, IPR2020-01023, filed Jun. 3, 2020, Memorandum, Treatment of Statements of the Applicant in the Challenged Patent in Inter Partes Reviews Under Section 311.
Petition for Inter Partes Review of U.S. Pat. No. 9,909,748, IPR2020-01023, filed Jun. 3, 2020, Patent Owner Preliminary Response.
Petition for Inter Partes Review of U.S. Pat. No. 9,909,748, IPR2020-01023, filed Jun. 3, 2020, Declaration of Dr. Robert F. Karlicek in Support of Patent Owner's Preliminary Response.
Petition for Inter Partes Review of U.S. Pat. No. 9,909,748, IPR2020-01023, filed Jun. 3, 2020, Karlicek Full C.V.
Petition for Inter Partes Review of U.S. Pat. No. 9,909,748, IPR2020-01023, filed Jun. 3, 2020, Karlicek Declaration, Exhibit 2017.
Petition for Inter Partes Review of U.S. Pat. No. 9,909,748, IPR2020-01023, filed Jun. 3, 2020, Karlicek Declaration, Exhibit 2015.
Petition for Inter Partes Review of U.S. Pat. No. 9,909,748, IPR2020-01023, filed Jun. 3, 2020, Karlicek Declaration, Exhibit 2018.
Petition for Inter Partes Review of U.S. Pat. No. 9,909,748, IPR2020-01023, filed Jun. 3, 2020, Karlicek Declaration, Exhibit 2016.
Petition for Inter Partes Review of U.S. Pat. No. 9,909,748, IPR2020-01023, filed Jun. 3, 2020, Reply to Patent Owner's Preliminary Response.
Petition for Inter Partes Review of U.S. Pat. No. 9,909,748, IPR2020-01023, filed Jun. 3, 2020, Patent Owner Sur-Reply in Support of Patent Owner Preliminary Response.

(56) References Cited

OTHER PUBLICATIONS

Petition for Inter Partes Review of U.S. Pat. No. 9,909,748, IPR2020-01023, filed Jun. 3, 2020, Decision Granting Instituion of Inter Partes Review.
Petition for Inter Partes Review of U.S. Pat. No. 9,909,748, IPR2020-01023, filed Jun. 3, 2020, Scheduling Order.
Petition for Inter Partes Review of U.S. Pat. No. 9,909,748, IPR2020-01023, filed Jun. 3, 2020, Patent Owner's Objections under 37 CFR 42.64 to Petitioner's Evidence.
Petition for Inter Partes Review of U.S. Pat. No. 9,909,748, IPR2020-01023, filed Jun. 3, 2020, Patent Owner's Request for Rehearing.
Petition for Inter Partes Review of U.S. Pat. No. 9,909,748, IPR2020-01023, filed Jun. 3, 2020, Petitioner's Response to Patent Owner's Request for Rehearing.
Petition for Inter Partes Review of U.S. Pat. No. 9,909,748, IPR2020-01023, filed Jun. 3, 2020, Petitioner's Notice of Service of Supplemental Evidence.
Petition for Inter Partes Review of U.S. Pat. No. 9,909,748, IPR2020-01023, filed Jun. 3, 2020, Decision Denying Patent Owner's Request for Rehearing on Institution, dated Feb. 3, 2021.
Petition for Inter Partes Review of U.S. Pat. No. 9,909,748, IPR2020-01023, filed Jun. 3, 2020, Notice of Joint Stipulation to Modify Dates 1-3, Feb. 24, 2021.
Petition for Inter Partes Review of U.S. Pat. No. 10,190,760, IPR2020-01024, filed Jun. 3, 2020, Patent Owner Preliminary Response.
Petition for Inter Partes Review of U.S. Pat. No. 10,190,760, IPR2020-01024, filed Jun. 3, 2020, Declaration of Dr. Robert F. Karlicek in Support of Patent Owner's Preliminary Response.
Petition for Inter Partes Review of U.S. Pat. No. 10,190,760, IPR2020-01024, filed Jun. 3, 2020, Reply to Patent Owner's Preliminary Response.
Petition for Inter Partes Review of U.S. Pat. No. 10,190,760, IPR2020-01024, filed Jun. 3, 2020, Patent Owner Sur-Reply in Support of Patent Owner Preliminary Response.
Petition for Inter Partes Review of U.S. Pat. No. 10,190,760, IPR2020-01024, filed Jun. 3, 2020, Decision Granting Instituion of Inter Partes Review.
Petition for Inter Partes Review of U.S. Pat. No. 10,190,760, IPR2020-01024, filed Jun. 3, 2020, Scheduling Order.
Petition for Inter Partes Review of U.S. Pat. No. 10,190,760, IPR2020-01024, filed Jun. 3, 2020, Patent Owner's Objections under 37 CFR 42.64 to Petitioner's Evidence.
Petition for Inter Partes Review of U.S. Pat. No. 10,190,760, IPR2020-01024, filed Jun. 3, 2020, Patent Owner's Request for Rehearing.
Petition for Inter Partes Review of U.S. Pat. No. 10,190,760, IPR2020-01024, filed Jun. 3, 2020, Petitioner's Response to Patent Owner's Request for Rehearing.
Petition for Inter Partes Review of U.S. Pat. No. 10,190,760, IPR2020-01024, filed Jun. 3, 2020, Petitioner's Notice of Service of Supplemental Evidence.
Petition for Inter Partes Review of U.S. Pat. No. 10,190,760, IPR2020-01024, filed Jun. 3, 2020, Decision Denying Patent Owner's Request for Rehearing on Institution, Feb. 3, 2021.
Petition for Inter Partes Review of U.S. Pat. No. 10,190,760, IPR2020-01024, filed Jun. 3, 2020, Notice of Joint Stipulation to Modify Dates 1-3, Feb. 24, 2021.
United States District Court for the Eastern District of New York Central Islip Division, Case 2:19-cv-06268-MKB-ST, Defendant's Local Patent Rule 7 Invalidity Contentions.
United States District Court for the Eastern District of New York Central Islip Division, Case 2:19-cv-06268-MKB-ST, Document 52, Letter re Joint Proposed Order for Electronic Discovery (5 pages).
United States District Court for the Eastern District of New York Central Islip Division, Case 2:19-cv-06268-MKB-ST, Document 53, Joint Claim Construction Chart (11 pages).
United States District Court for the Eastern District of New York Central Islip Division, Case 2:19-cv-06268-MKB-ST, Document 54, Opening Claim Construction Brief of Plaintiff Autronic Plastics (28 pages, exhibits not attached to the document).
United States District Court for the Eastern District of New York Central Islip Division, Case 2:19-cv-06268-MKB-ST, Document 55, Defendant's Responsive Claim Construction Brief (31 pages, exhibits not attached to the document).
United States District Court for the Eastern District of New York Central Islip Division, Case 2:19-cv-06268-MKB-ST, Document 56, Plaintiff's Claim Construction Reply Brief (15 pages).
United States District Court for the Eastern District of New York Central Islip Division, Case 2:19-cv-06268-MKB-ST, Document 58, Civil Minute Entry (1 page).

* cited by examiner

LIGHTING ASSEMBLY

CROSS REFERENCE TO RELATED APPLICATIONS

This application is a continuation application claiming priority to U.S. patent application Ser. No. 15/455,872 filed Mar. 10, 2017, which is a continuation application claiming priority to U.S. patent application Ser. No. 13/271,115 filed Oct. 11, 2011, U.S. Pat. No. 9,625,139 issued Apr. 18, 2017, which claims the benefit of U.S. Provisional Patent Application No. 61/391,608 filed Oct. 9, 2010; the disclosures of each are incorporated herein by reference.

BACKGROUND OF THE DISCLOSURE

1. Technical Field

The disclosure generally relates to LED lighting devices and, more particularly, to modular LED lighting units that may be uniquely configured by the user at the location where the lighting is desired.

2. Background Information

Although the benefits of upgrading traditional lighting to efficient lighting based on light emitting diodes (LEDs) is known, additional LED lighting configurations are desired in the marketplace.

SUMMARY OF THE DISCLOSURE

The disclosure provides a modular lighting assembly using LED banks as the light sources. The assembly allows the power supply and LED banks to be independently replaced. The assembly uses a power supply that is separated from the LED banks and electrically connected to the LED banks with a plug connector that may be unplugged and plugged back in to allow the power supply or LED bank to be independently and readily replaced.

The disclosure provides an assembly that provides for easy replacement of the different components of the assembly. One feature that makes the components easier to replace is that the light modules and/or the power supply may be carried by the housing that is removable from the base mount that is secured to a mounting structure such as a wall or ceiling. This configuration allows the replacement to occur at ground level rather than requiring the worker to be positioned up on a ladder.

The disclosure also provides a mount that allows the power supply and LED banks to be placed at different locations and allows for the LED banks and power supplies to be removed and replaced.

The mount allows the light generated from the system to be directed in different directions based on the installation position of the LED banks. The housing that mounts the light modules is angled at different directions with respect to its base to cast the light generated by the light modules in desired directions.

The disclosure also provides a lighting assembly that has a low power mode that may be activated to reduce power consumption. The low power mode may be activated manually, automatically, or remotely.

The disclosure also provides a lighting assembly that may be used in underground applications including underground train systems.

The disclosure provides a LED lighting assembly that may be powered from a 480V, three phase input.

The disclosure provides a lighting assembly with improved efficiency.

BRIEF DESCRIPTION OF THE DRAWINGS

Similar numbers refer to similar parts throughout the specification.

DETAILED DESCRIPTION OF THE DISCLOSURE

Figure 1:
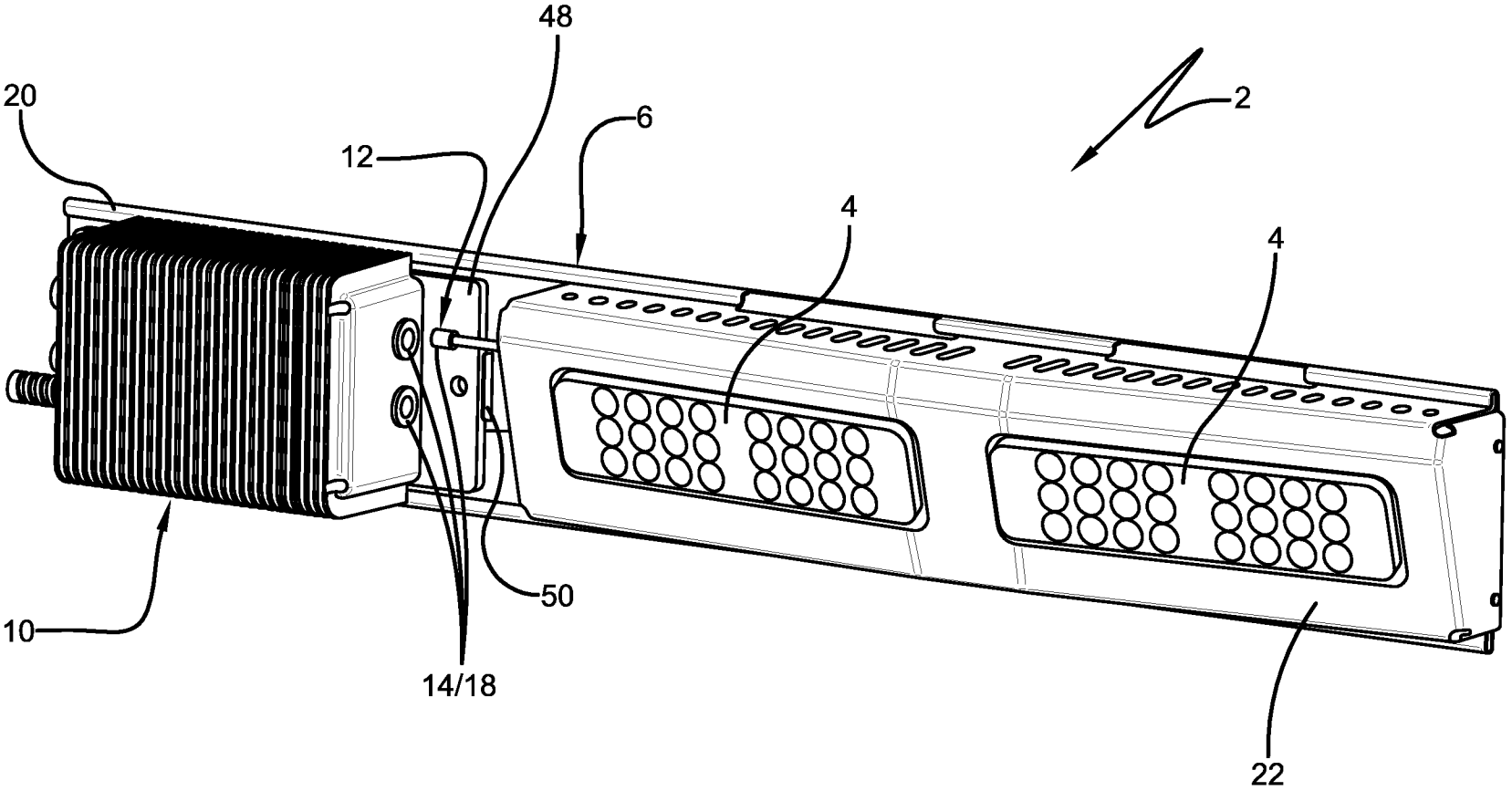
FIG. 1 is perspective view of an exemplary modular light assembly.

An exemplary configuration of a lighting assembly is indicated generally by the numeral 2 in the accompanying drawings. Lighting assembly 2 may be used in a wide variety of environments and is particularly configured for underground utility or underground transportation applications. Assembly 2 may be used for tunnel lighting, subways, parking garages, harsh-environment conditions, architectural and industrial operations including petroleum, mining, and power generation. Assembly 2 is configured to function in damp environments and is configured to be impervious to dust such as steel dust and corrosion. Assembly 2 is configured to have an operating temperature in the general range of −20° to 50° C.

Assembly 2 uses a plurality of light emitting diode (LED) light sources grouped to function as a single light source referred to herein as an LED banks or LED light module 4. Module 4 provides the desired light from assembly 2. Assembly 2 allows the individual elements of the assembly to be replaced and reconfigured as desired by the end user. Assembly 2 allows the user to select the type of light module 4 used at different locations. For example, the user may install large and small light modules 4, different color light modules 4, light modules 4 having different shapes, or light modules 4 of differing lumen output. The LEDs are configured with an automotive-grade polycarbonate lens assembly. The injection molded components are low smoke, zero halogen (LSZH). Each module 4 includes a die-cast aluminum heat sink. Each module 4 has a LED Driver operating voltage of 100-277 VAC, 480 VAC. Alternate high-voltage AC/DC input may be provided. The power consumption for one exemplary configuration is 60 Watts. The LEDs may be high-output bright white LED's (~4700K). The LEDs have a rated life of 70% lumen maintenance at 50,000 hours. Modules 4 use the proprietary, precision Opticlear™ Engine to maximize light distribution to target area while minimizing glare.

Assembly 2 generally includes at least one LED module 4, a mount 6, and a power supply 10. Mount 6 is configured to carry at least one module 4 and a power supply 10. A plurality of identical or different light modules 4 may be carried by mount 6. Mount 6 may be provided in different configurations to direct the light produced by assembly 2 in different directions. Each module 4 and supply 10 may be readily mounted and dismounted to mount 6 and may be connected and disconnected from each other to allow each individual element to be replaced as needed.

Figure 4:
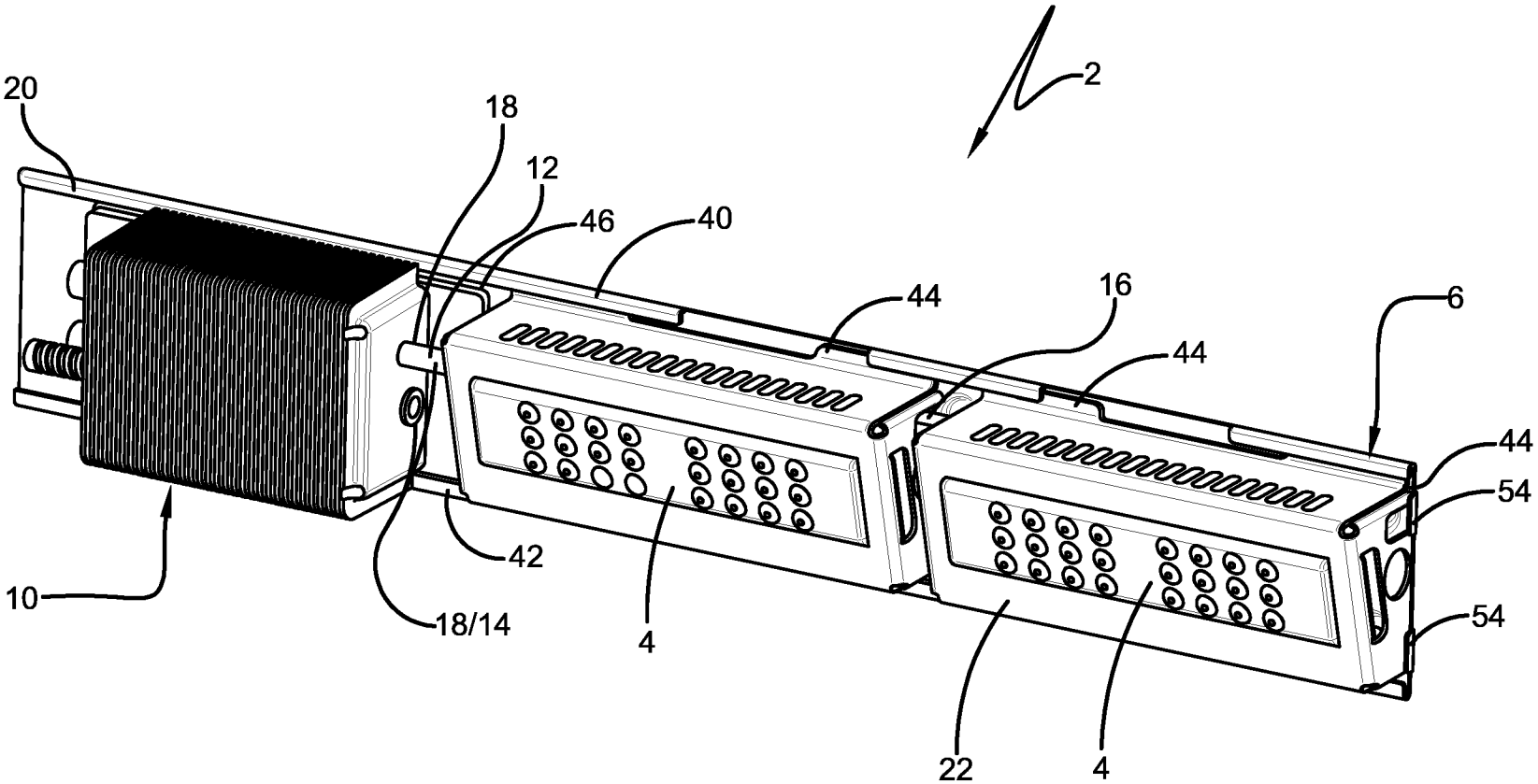
FIG. 4 is a view similar to FIG. 1 showing an alternative configuration for the modular light and mount.

Power supply 10 transforms the alternating current from commonly available electrical power sources such as 110V or 220V or a high voltage source such as 480V-three phase, to a low voltage direct current power supply that is delivered to module 4 with a supply cord 12. Supply cord 12 (shown disconnected in FIG. 1 and connected in FIG. 4), power supply 10, and/or module 4 include connectors 14 configured to allow cord 12 to be readily connected and disconnected from supply 10 and/or module 4. Connectors 14 may be waterproof and locking. A waterproof IP67 connector may be used. As shown in FIG. 4, modules 4 may be connected together with a secondary electrical connector 16 such that the electrical supply flows through one module 4A to the second module 4B. Alternatively, power supply 10 may include multiple outlets 18 with an independent supply cord 12 used with each module 4. Power supply 10 may include a plug that allows assembly 2 to be plugged into the available electrical source or assembly 2 may be hard wired into the electrical source. Power supply 10 may be configured to function with a wide range of input voltages and may be configured to withstand power spikes. In the exemplary configuration, power supply 10 outputs a 24V to each supply cord 12. Power supply 10 may be double fused.

Assembly 2 may be provided with a low power feature that may be activated to reduce the amount of power consumed by assembly 2. In one configuration, the low power mode reduces power consumption by 75 percent. The low power mode may be activated and deactivated with a button or switch on power supply 10. Other configurations allow the low power mode to be activated or deactivated remotely through a wireless connection, through a computer network connection such as an Internet connection, and/or through a powerline network. These activation methods also may be used to turn assembly 2 on and off. Communication between power supply 10 and the controlling device (which may be a computer or a timer) may be through a computer network such as the Internet or an intranet, through a telephone network, through a wireless communication channel, or through any other suitable communication channel.

Mount 6 includes a base 20 and a housing 22. Base 20 is configured to be secured to a structure such as a wall or ceiling while housing 22 carries module 4 or modules 4. Modules 4 may be secured to housing 22 with connectors, a snap fit connection, or the like. Housing 22 defines an opening for each bank of LEDs in module 4. In other configurations, housing 22 is configured to carry or at least cover power supply 10. Housing 22 is readily removably from base 20 so that module 4, modules 4, or supply 10 may be replaced, reconfigured, or serviced. When module 4 is to be replaced, module 4 is unplugged from supply 10 and housing 22 and module 4 are removed together so that the replacement module 4 may be inserted into housing 22 in a location separate from the location where base 20 remains mounted.

Housing 22 may be angled up, down, left, right, or parallel with respect to base 20. When housing 22 carries multiple modules 4, housing 22 may be configured to hold modules 4 at different angles with respect to base plate 28. In the exemplary configuration, housing 22 is angled down with respect to base 20 such that the light produced by module 4 or modules 4 is angled down. As such, when base 20 is mounted to a vertical surface such as a wall, the light produced by assembly 2 is angled down toward the floor. Also in the exemplary configuration, the center of housing 22 is taller than the ends of housing 22 so that the two different light modules 4 carried by housing 22 are angled away from each other.

Housing 22 may define a plurality of openings to allow air to circulate around module 4, modules 4, and power supply 10.

Base 20 includes a generally flat base plate 28 that defines a plurality of mounting holes 30 that allow base 20 to be secured to a wide variety of surfaces with a wide variety of connectors. Each mounting hole is defined by a portion of plate 28 that projects rearwardly from a planar rear surface portion of plate 28. Base plate 28 has a first end 32, a second end 34, an upper edge 36, and a lower edge 38. Channels are defined along upper and lower edges 36 and 38 with lips 40 and 42, respectively.

Figure 2:
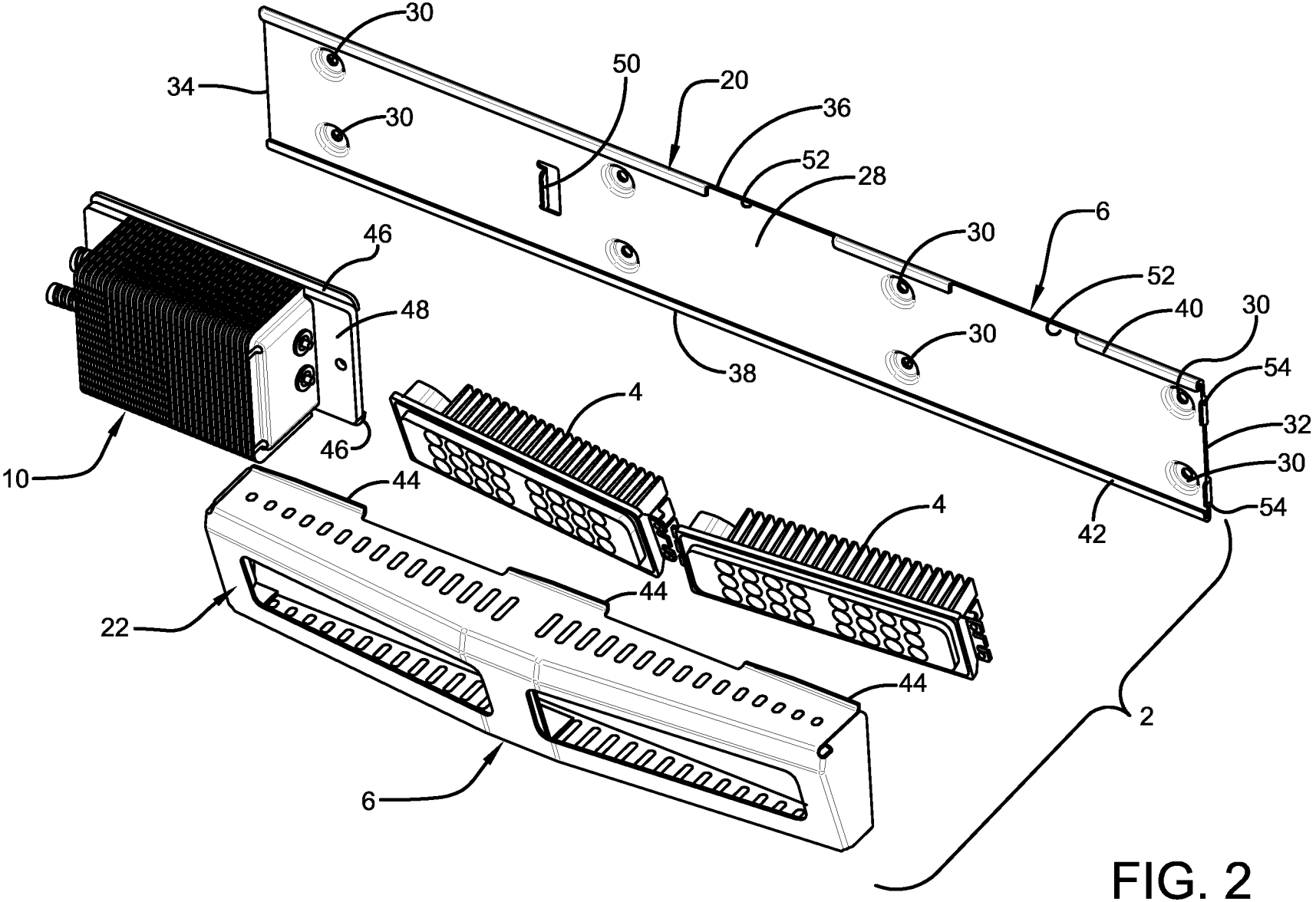
FIG. 2 is an exploded perspective view of the assembly of FIG. 1.
Figure 3:
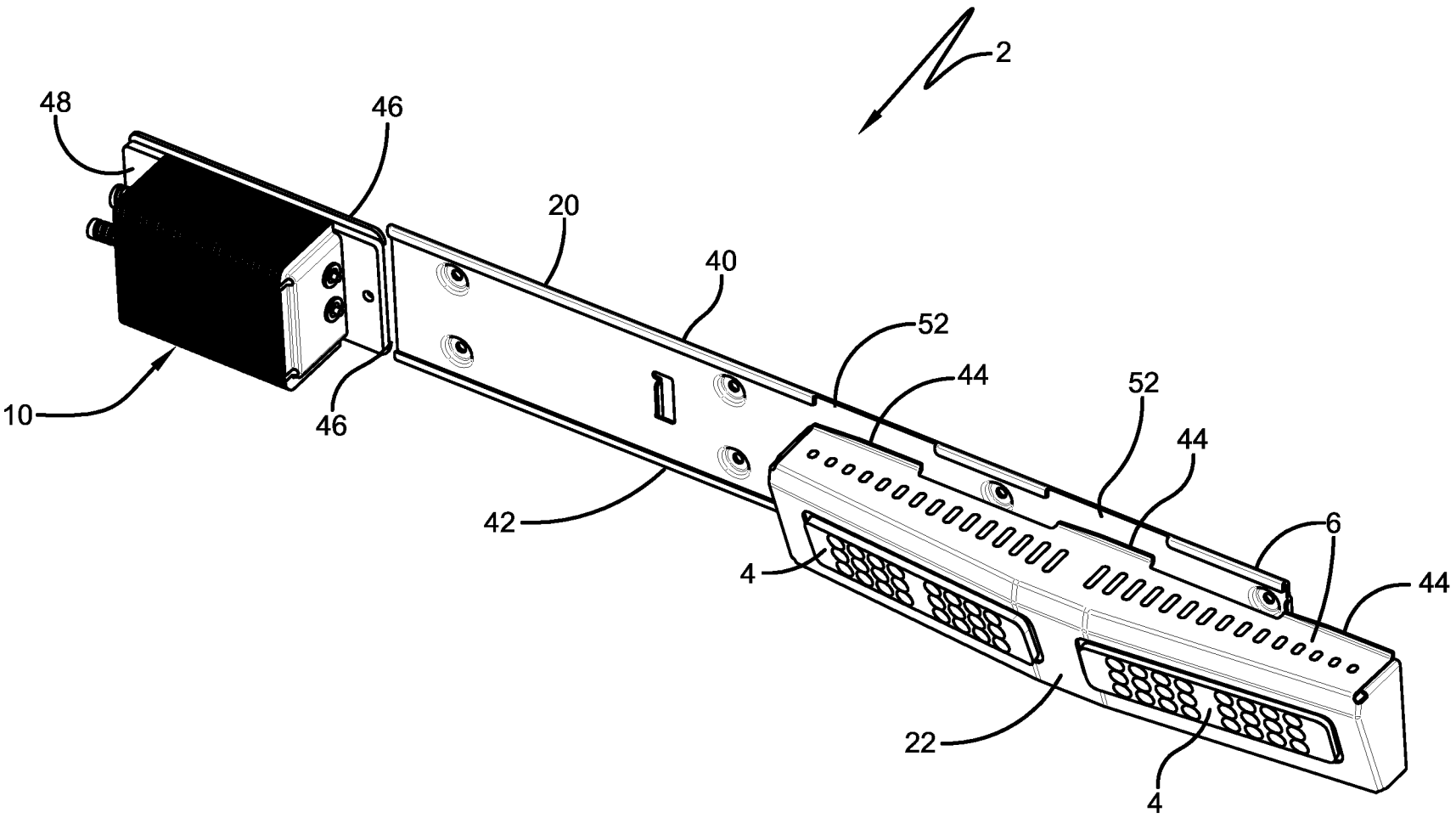
FIG. 3 is an exploded perspective view showing how the power supply and LED banks interact with the mount.

Flanges 44 projecting from housing 22 are sized to slide within these channels between lips 40/42 and base plate 28 to retain housing 22 with respect to base 20. Power supply 10 includes its own flanges 46 that project from a power supply mounting plate 48 that mounts power supply 10 to base in the same manner. Flanges 44/46 may be freely slidable within the channels or may be tapered to allow for easy insertion and frictional locking within the channels. The frictional locking occurs when the tip-to-tip distance from flange 44 to the opposite flange 44 is essentially the same dimension—or just smaller than—the dimension from the inside of one channel to the inside of the other channel. FIGS. 2 and 3 depict tapered ends on flanges 44 while FIG. 4 depicts rounded ends. Flanges 44 also may be frictionally pinched by being slightly thicker than the channels.

Power supply 10 may be connected to base 20 by sliding flanges 46 into the open end of the channels behinds lips 40/42 at second end 34 of base 20. A stop 50 projects forward from base plate 28. Power supply 10 abuts stop 50 when in the proper position. A connector, such as a screw or bolt, may be used to secure power supply 10 in place. Supply cord 12 also holds power supply 10 in place. Alternatively, flanges 46 may be configured to lock into the channels with friction fits or snap fits. In other configurations, power supply 10 is mounted within and carried by housing 22.

Flanges 44 may be continuous such that housing 22 is slid into the channels through first end 32 in the same manner as power supply 10. In the exemplary configuration, flanges 44 are spaced and lip 40 defines gaps 52 so that housing 22 may be installed by resting its lower flange 44 behind lip 42 with the upper flanges 44 aligned with gaps 52. Housing 22 is then pivoted toward plate 28 until its upper flanges 44 are aligned with the channel behind lip 40. Housing 22 is then slid sideways until at least a portion of the upper flanges 44 are disposed behind lip 40.

There are alternatives to lock housing 22 in place with respect to base 20. Flanges 44 may be configured to lock into the channels with snap fitting members. Alternatively, a mechanical connector may be used between housing 22 and base 20.

In one configuration, gaps 52 are configured to allow housing to be positioned behind lips 40/42 and slid to the right until housing abuts stop flanges 54. In other configurations, flanges 54 pivot out of the way or are configured to not interfere with housing 22 during the installation of housing 22.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustrations provided herein are examples and the invention is not limited to the exact details shown or described. Throughout the description and claims of this specification the words "comprise"

and "include" as well as variations of those words, such as "comprises," "includes," "comprising," and "including" are not intended to exclude additives, components, integers, or steps.

The invention claimed is:

1. A light fixture, comprising:

a mount having a base which has a first and second spaced edges that run in a longitudinal direction of the base;

the base defining a first channel formed along the first edge and a second channel formed along the second edge;

the base including a first lip projecting toward the second channel; the first lip defining the first channel as a three-sided open channel;

the base including a second lip projecting toward the first channel; the second lip defining the second channel as a three-sided open channel;

the second lip defining a gap having a length;

the mount also including a housing mountable to the base through engagement with the first and second channels;

the housing being selectively movable with respect to the base between a retained closed condition wherein an interior of the housing is closed by the base and an open condition wherein the interior of the housing is accessible;

the housing including a first flange extending into the first channel;

when the housing is in the retained closed condition, the housing including a second flange extending into a locked position within the second channel to secure the housing in the retained closed condition;

the second flange having a length that is less than the length of the gap such that the second flange can be pivoted into the second channel through the gap and then slid along the second channel behind a portion of the second lip;

an LED module having a plurality of light emitting diodes; the LED module being carried by the housing intermediate the first and second spaced edges of the base; and a power supply for the LED module electrically connected with the LED module and being disposed intermediate the first and second spaced edges of the base.

2. The light fixture of claim 1, wherein a plurality of LED modules are carried by the housing intermediate the first and second spaced edges of the base; the plurality of LED modules being in longitudinal alignment.

3. The light fixture of claim 2, wherein the LED modules are longitudinally spaced apart within the housing.

4. The light fixture of claim 1, wherein the housing defines an opening; the LED module being aligned with the opening to position the plurality of light emitting diodes in alignment with the opening.

5. The light fixture of claim 4, wherein the housing defines a plurality of spaced openings aligned in the longitudinal direction; an LED module having a plurality of light emitting diodes disposed in alignment with each opening.

6. The light fixture of claim 5, wherein the power supply is in longitudinal alignment with the LED modules.

7. The light fixture of claim 1, wherein the power supply is spaced from the LED module.

8. The light fixture of claim 1, wherein the power supply is carried by the housing.

9. The light fixture of claim 1, wherein the power supply is secured to the base.

10. The light fixture of claim 1, wherein the power supply is electrically connected to the LED module with a first electrical connector that selectively connects the LED module to the power supply such that the connection may be made and remade as desired such that the power supply may be selectively disconnected from the LED module to allow for removal and replacement.

11. The light fixture of claim 1, wherein the second flange is tapered to frictionally lock in the second channel.

12. The light fixture of claim 1, wherein the second lip defines spaced gaps and the housing has a second flange for each gap.

13. The light fixture of claim 1, wherein the base includes a stop flange; the housing engaging the stop flange when the housing is in the retained closed condition.

* * * * *